US011088454B2

(12) United States Patent
Aliakbarian et al.

(10) Patent No.: US 11,088,454 B2
(45) Date of Patent: Aug. 10, 2021

(54) INCREASING BANDWIDTH OF A DIPOLE ANTENNA

(71) Applicants: Hadi Aliakbarian, Tehran (IR); Amir Sahraei, Tehran (IR)

(72) Inventors: Hadi Aliakbarian, Tehran (IR); Amir Sahraei, Tehran (IR)

(73) Assignees: K.N. TOOSI UNIVERSITY OF TECHNOLOGY, Tehran (IR); Amir Sahraei, Tehran (IR); Hadi Aliakbarian, Tehran (IR)

( * ) Notice: Subject to any disclaimer, the term of this patent is extended or adjusted under 35 U.S.C. 154(b) by 0 days.

(21) Appl. No.: 16/553,298

(22) Filed: Aug. 28, 2019

(65) Prior Publication Data

US 2019/0393608 A1 Dec. 26, 2019

Related U.S. Application Data

(60) Provisional application No. 62/723,491, filed on Aug. 28, 2018.

(51) Int. Cl.

| | |
|---|---|
| ***H01Q 9/22*** | (2006.01) |
| ***H01Q 9/16*** | (2006.01) |
| ***H01Q 9/20*** | (2006.01) |
| ***H01Q 9/26*** | (2006.01) |
| ***H01Q 9/24*** | (2006.01) |

(52) U.S. Cl.
CPC ..... *H01Q 9/22* (2013.01); *H01Q 9/16* (2013.01); *H01Q 9/20* (2013.01); *H01Q 9/24* (2013.01); *H01Q 9/265* (2013.01)

(58) Field of Classification Search
CPC .. H01Q 9/16; H01Q 9/20; H01Q 9/28; H01Q 5/47; H01Q 9/22; H01Q 9/24; H01Q 9/265; H01Q 5/50
See application file for complete search history.

(56) References Cited

U.S. PATENT DOCUMENTS

| | | | | |
|---|---|---|---|---|
| 5,387,919 | A * | 2/1995 | Lam | H01Q 9/18 343/795 |
| 7,064,728 | B1 * | 6/2006 | Lin | H01Q 1/242 343/790 |
| 7,248,227 | B2 * | 7/2007 | Chen | H01Q 1/38 343/700 MS |
| 8,593,363 | B2 * | 11/2013 | McLean | H01Q 9/22 343/792 |
| 8,816,925 | B2 * | 8/2014 | Apostolos | H01P 3/08 343/792 |
| 9,496,609 | B2 * | 11/2016 | Marshall | H04W 72/0453 |
| 9,692,124 | B2 * | 6/2017 | Caimi | H01Q 21/12 |

* cited by examiner

*Primary Examiner* — Vibol Tan
(74) *Attorney, Agent, or Firm* — Bajwa IP Law Firm; Haris Zaheer Bajwa

(57) ABSTRACT

A dipole antenna is disclosed. The dipole antenna includes a first arm, a second arm, and a first conductive plate. The first conductive plate is placed inside one of the first arm or the second arm. The first conductive plate creates a cavity inside the one of the first arm or the second arm.

17 Claims, 16 Drawing Sheets

100

104

INCREASING BANDWIDTH OF A DIPOLE ANTENNA

CROSS-REFERENCE TO RELATED APPLICATION

This application claims the benefit of priority from pending U.S. Provisional Patent Application Ser. No. 62/723,491, filed on Aug. 28, 2018, and entitled "A SIMPLE AND EFFECTIVE METHOD TO INCREASE DIPOLE ANTENNA'S BANDWIDTH," which is incorporated herein by reference in its entirety.

TECHNICAL FIELD

The present disclosure generally relates to antennas, and particularly, to dipole antennas.

BACKGROUND

Dipole antennas are a type of wired antennas for wireless communication systems that have specific characteristics such as omnidirectional radiation patterns. Lengths of conventional dipole antennas may be about half of operating wavelengths. Designing dipole antennas with a smaller size may reduce gain or bandwidth. Therefore, designing a portable and small size dipole antenna in low-frequency bands (such as VHF and UHF bands) may be challenging due to large wavelengths corresponding to low-frequency bands.

A problem of dipole antennas may be their relatively narrow impedance bandwidth. Bandwidths of dipole antennas may be made wider by increasing lengths or diameters of dipole antennas. This approach may be undesired because it may increase sizes of dipole antennas. Besides, sizes of dipole antennas may have a limited effect on bandwidth. Some loading techniques may be implemented for an increase in dipole antennas bandwidths. However, utilizing these techniques may increase complexity, cost, and size of dipole antennas.

There is, therefore, a need for a method for increasing bandwidth of dipole antennas without increasing sizes of dipole antennas. There is further a need for a dipole antenna that provides a wide bandwidth in low-frequency bands without an increased size.

SUMMARY

This summary is intended to provide an overview of the subject matter of the present disclosure and is not intended to identify essential elements or key elements of the subject matter, nor is it intended to be used to determine the scope of the claimed implementations. The proper scope of the present disclosure may be ascertained from the claims set forth below in view of the detailed description below and the drawings.

In one general aspect, the present disclosure describes an exemplary dipole antenna. An exemplary dipole antenna may include a first arm, a second arm, and a first conductive plate. In an exemplary embodiment, the first conductive plate may be placed inside one of the first arm or the second arm. In an exemplary embodiment, the first conductive plate may create a cavity inside the one of the first arm or the second arm.

In an exemplary embodiment, the dipole antenna may further include a coaxial feed line. In an exemplary embodiment, the coaxial feed line may electrically feed the dipole antenna by passing through the first arm. In an exemplary embodiment, the coaxial feed line may include a conductive shield and a center core. In an exemplary embodiment, the conductive shield may be in contact with the first conductive plate. In an exemplary embodiment, the conductive shield may pass through a hole on the first conductive plate. In an exemplary embodiment, the center core may be connected to an outer surface of the second arm.

In an exemplary embodiment, the first arm may include a first cylindrical body and a second conductive plate. In an exemplary embodiment, the second conductive plate may be placed at a first circular boundary of the first cylindrical body. In an exemplary embodiment, the second conductive plate may be configured to be in contact with the first cylindrical body. In an exemplary embodiment, the second arm may include a second cylindrical body. In an exemplary embodiment, the coaxial feed line may be configured to pass through a second circular boundary of the first cylindrical body.

In an exemplary embodiment, the conductive shield may be connected to the second conductive plate. In an exemplary embodiment, the center core may pass through a hole on the second conductive plate. In an exemplary embodiment, the center core may further pass through a circular boundary of the second cylindrical body. In an exemplary embodiment, the center core may be connected to the first conductive plate.

In an exemplary embodiment, the dipole antenna may further include a ferrite sleeve. In an exemplary embodiment, the ferrite sleeve may be mounted around the coaxial feed line. In an exemplary embodiment, the ferrite sleeve may include a cylindrical ring. In an exemplary embodiment, a distance between an inner surface of the cylindrical ring and the coaxial feed line may be smaller than about 2 mm. In an exemplary embodiment, the ferrite sleeve may include an electrical impedance higher than about 100Ω. In an exemplary embodiment, at least about 90% of the ferrite sleeve may be disposed inside the first arm. In an exemplary embodiment, a material of at least one of the first arm and the second arm may include brass.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION

In the following detailed description, numerous specific details are set forth by way of examples in order to provide a thorough understanding of the relevant teachings. However, it should be apparent that the present teachings may be practiced without such details. In other instances, well known methods, procedures, components, and/or circuitry have been described at a relatively high-level, without detail, in order to avoid unnecessarily obscuring aspects of the present teachings.

The following detailed description is presented to enable a person skilled in the art to make and use the methods and devices disclosed in exemplary embodiments of the present disclosure. For purposes of explanation, specific nomenclature is set forth to provide a thorough understanding of the present disclosure. However, it will be apparent to one skilled in the art that these specific details are not required to practice the disclosed exemplary embodiments. Descriptions of specific exemplary embodiments are provided only as representative examples. Various modifications to the exemplary implementations will be readily apparent to one skilled in the art, and the general principles defined herein may be applied to other implementations and applications without departing from the scope of the present disclosure. The present disclosure is not intended to be limited to the implementations shown but is to be accorded the widest possible scope consistent with the principles and features disclosed herein.

Herein is disclosed an exemplary method and apparatus for increasing bandwidth of a dipole antenna by creating a cavity inside an arm of the dipole antenna. An exemplary cavity may be created by placing a conductive plate inside an arm of the antenna. A coaxial feed line may electrically feed the dipole antenna by passing through inside an arm of the antenna. The cavity may match the impedance of the dipole antenna with that of the feed line, thereby increasing the antenna's bandwidth. As a result, the antenna's bandwidth may be increased without an increase in the size of the antenna, since there may be no need for an extra inductive or capacitive load for impedance matching. An exemplary dipole antenna may be utilized in various communication systems that require limited size antennas with omnidirectional radiation patterns. Applications of such systems may include radio broadcasting, especially in low-frequency bands including VHF and UHF bands, military applications, etc.

An exemplary dipole antenna may include a first arm, a second arm, and a first conductive plate. In an exemplary embodiment, the first conductive plate may be placed inside one of the first arm or the second arm. In an exemplary embodiment, the first conductive plate may create a cavity inside the one of the first arm or the second arm.

Figure 1A:
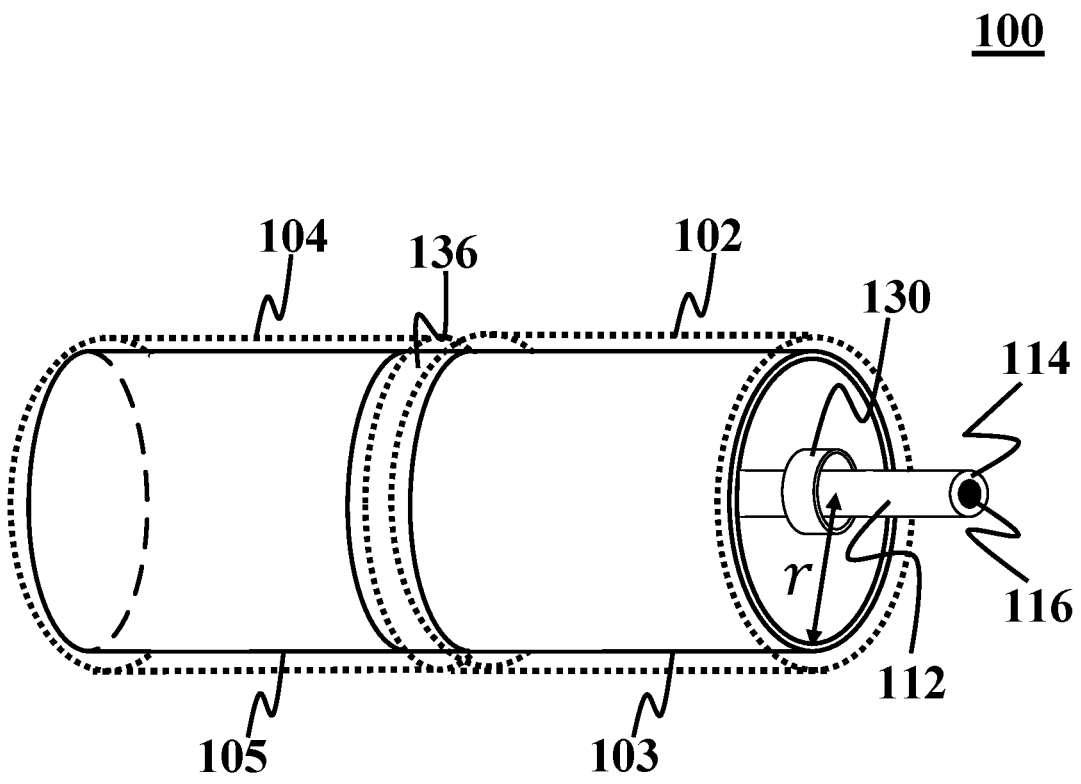
FIG. 1A shows a schematic of a dipole antenna, consistent with one or more exemplary embodiments of the present disclosure.

FIG. 1A shows a schematic of a dipole antenna, consistent with one or more exemplary embodiments of the present disclosure. In an exemplary embodiment, a dipole antenna 100 may include a first arm 102 and a second arm 104. In an exemplary embodiment, first arm 102 may include a first cylindrical body 103. In an exemplary embodiment, second arm 104 may include a second cylindrical body 105.

In an exemplary embodiment, an admittance may be associated with dipole antenna 100. An exemplary admittance may have a complex value including a real part (i.e., a conductance) and an imaginary part (i.e., a susceptance). In an exemplary embodiment, dipole antenna 100 may be a capacitive load when an associated susceptance is positive. In an exemplary embodiment, dipole antenna 100 may be an inductive load when the associated susceptance is negative. The susceptance of dipole antenna 100 may depend on a length of dipole antenna 100 and/or an operating wavelength. The operating wavelength of dipole antenna 100 may be associated with an operating frequency.

In an exemplary embodiment, being a capacitive or an inductive load may result in reducing a bandwidth of dipole antenna 100. The bandwidth of dipole antenna 100 may be associated with a range of operating frequencies of dipole antenna 100. In order to increase the bandwidth of dipole antenna 100, the capacitive or inductive load of dipole antenna 100 may be cancelled utilizing an additive inductive or an additive capacitive load. When dipole antenna 100 is capacitive, an additive inductive load may cancel the susceptance of dipole antenna 100 On the other hand, when dipole antenna 100 is inductive, an additive capacitive load may cancel the susceptance of dipole antenna 100.

In an exemplary embodiment, an additive inductive or an additive capacitive load may be implemented by including a cavity inside one of first arm 102 or second arm 104. An exemplary cavity may include a positive susceptance (i.e., a capacitive load) or a negative susceptance (i.e., an inductive load). In an exemplary embodiment, the susceptance of the cavity may depend on a length and/or a diameter of the cavity.

Figure 1B:
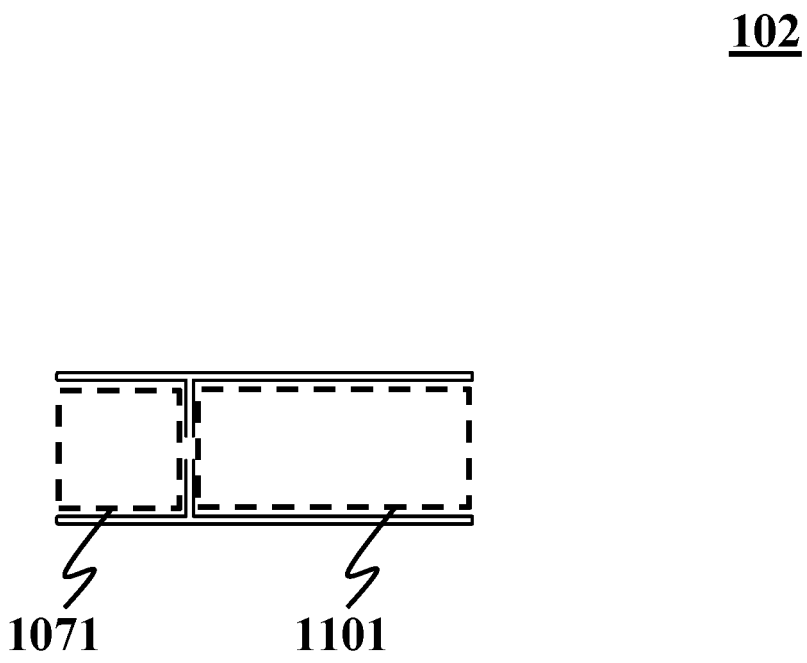
FIG. 1B shows a schematic of a cut view of a portion and a remaining of a first arm, consistent with one or more exemplary embodiments of the present disclosure.
Figure 1C:
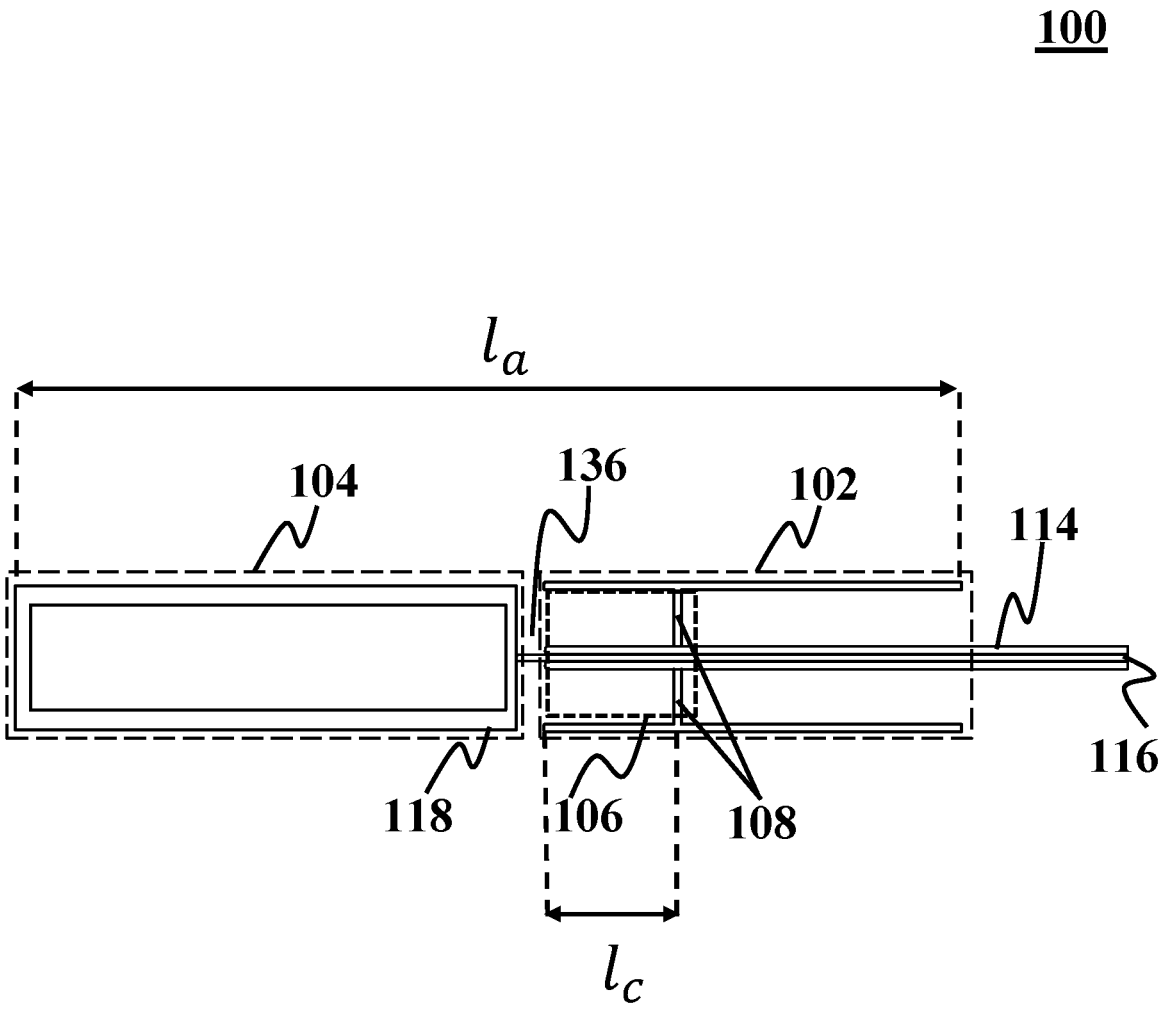
FIG. 1C shows a schematic of a cut view of a dipole antenna with a cavity inside a first arm, consistent with one or more exemplary embodiments of the present disclosure.

FIG. 1B shows a schematic of a cut view of a portion and a remaining of a first arm, consistent with one or more exemplary embodiments of the present disclosure. FIG. 1C shows a schematic of a cut view of a dipole antenna with a cavity inside a first arm, consistent with one or more exemplary embodiments of the present disclosure. Referring to FIGS. 1B and 1C, in an exemplary embodiment, a cavity 106 may include a portion 1071 of first arm 102. In an exemplary embodiment, cavity 106 may further include a first conductive plate 108. In an exemplary embodiment, first conductive plate 108 may be placed inside first arm 102. In an exemplary embodiment, first conductive plate 108 may separate portion 1071 of first arm 102 from a remaining 1101 of first arm 102.

Figure 1D:
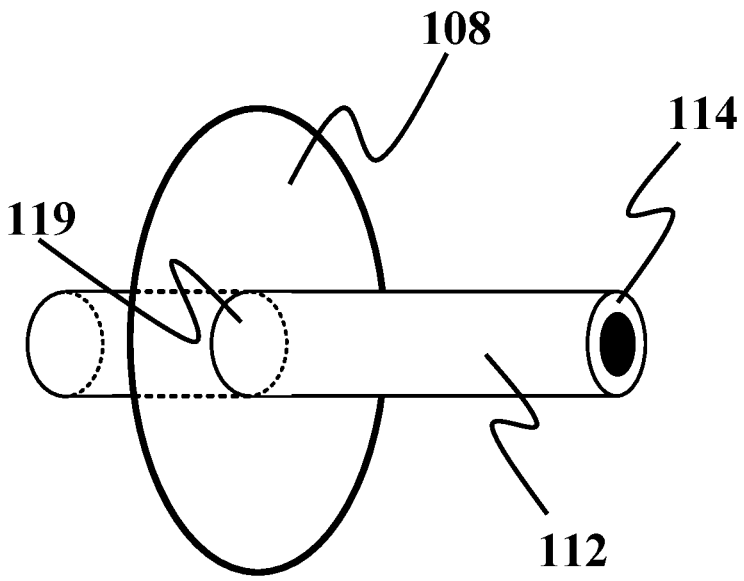
FIG. 1D shows a schematic of a conductive shield of a coaxial feed line passing through a hole on a conductive plate, consistent with one or more exemplary embodiments of the present disclosure.

FIG. 1D shows a schematic of a conductive shield of a coaxial feed line passing through a hole on a conductive plate, consistent with one or more exemplary embodiments of the present disclosure. Referring to FIGS. 1A-1D, in an exemplary embodiment, dipole antenna 100 may further include a coaxial feed line 112. In an exemplary embodiment, coaxial feed line 112 may be configured to electrically feed dipole antenna 100by passing through first arm 102. In an exemplary embodiment, coaxial feed line 112 may include a conductive shield 114 and a center core 116. In an exemplary embodiment, conductive shield 114 may pass through a hole 119 on first conductive plate 108. In an exemplary embodiment, conductive shield 114 may be in contact with first conductive plate 108. In an exemplary embodiment, center core 116 may be connected to an outer surface 118 of second arm 104. Passing conductive shield 114 through hole 119 may allow placing coaxial feed line 112 inside first arm 102 for electrically feeding dipole antenna 100, which may eliminate a need for increasing the size of dipole antenna 100.

Figure 1E:
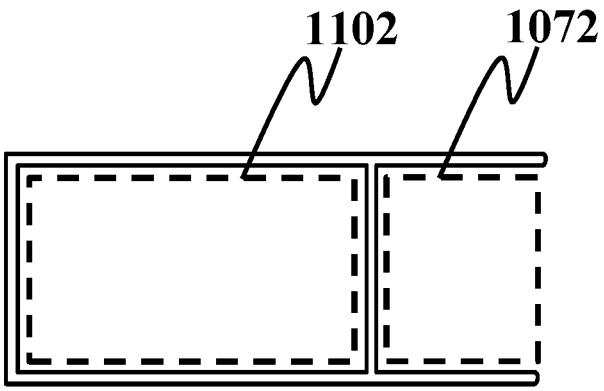
FIG. 1E shows a schematic of a cut view of a portion and a remaining of a second arm, consistent with one or more exemplary embodiments of the present disclosure.
Figure 1F:
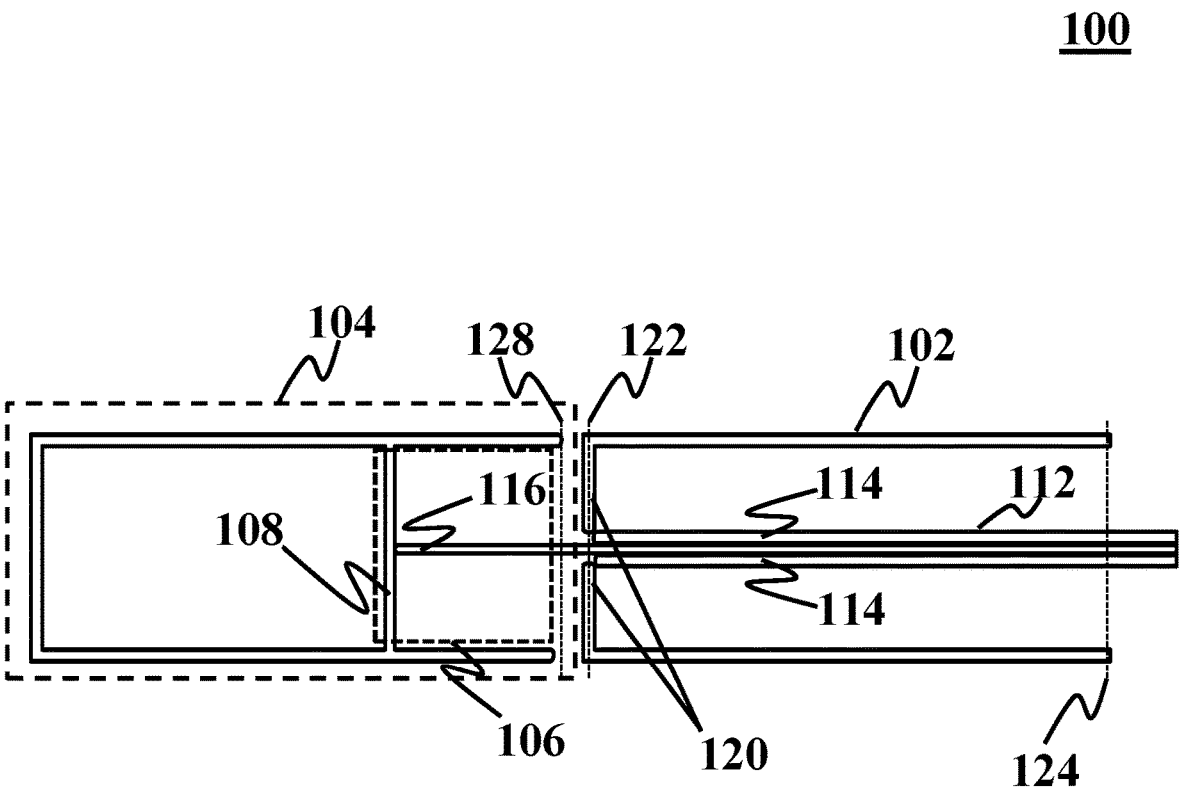
FIG. 1F shows a schematic of a cut view of a dipole antenna with a cavity inside a second arm, consistent with one or more exemplary embodiments of the present disclosure.

FIG. 1E shows a schematic of a cut view of a portion and a remaining of a second arm, consistent with one or more exemplary embodiments of the present disclosure. FIG. IF shows a schematic of a cut view of dipole antenna 100 with cavity 106 inside second arm 104, consistent with one or more exemplary embodiments of the present disclosure. Referring to FIGS. 1E and 1F, in an exemplary embodiment, a cavity 106 may include a portion 1072 of second arm 104. In an exemplary embodiment, cavity 106 may further include a first conductive plate 108. In an exemplary embodiment, first conductive plate 108 may be placed inside second arm 104. In an exemplary embodiment, first conductive plate 108 may separate portion 1072 of second arm 104 from a remaining 1102 of second arm 104.

Referring again to FIG. 1F, in an exemplary embodiment, first arm 102may further include a second conductive plate 120. In an exemplary embodiment, second conductive plate 120 may be placed at a first circular boundary 122 of first cylindrical body 103. In an exemplary embodiment, second conductive plate 120 may be be in contact with first cylindrical body 103. In an exemplary embodiment, coaxial feed line 112 may be configured to pass through a second circular boundary 124 of first cylindrical body 103.

Figure 1G:
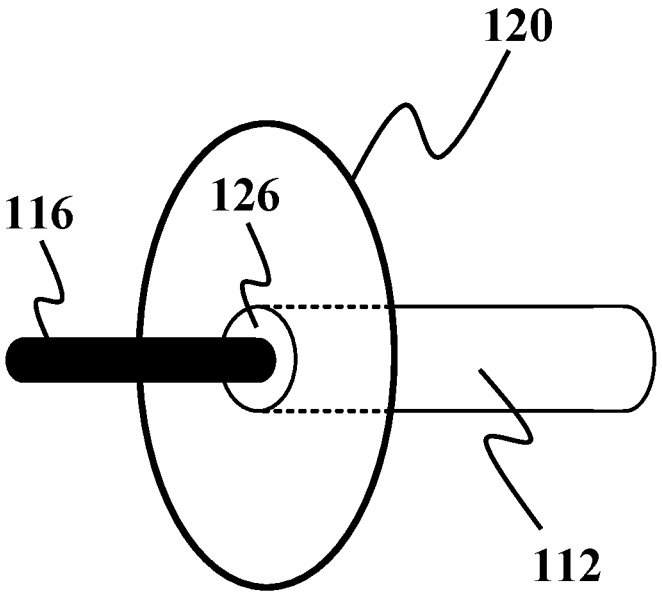
FIG. 1G shows a schematic of a center core of a coaxial feed line passing through a hole on a conductive plate, consistent with one or more exemplary embodiments of the present disclosure.

FIG. 1G shows a schematic of a center core of a coaxial feed line passing through a hole on a conductive plate, consistent with one or more exemplary embodiments of the present disclosure. Referring to FIGS. IF and 1G, in an exemplary embodiment, conductive shield 114 may be connected to second conductive plate 120. In an exemplary embodiment, center core 116 may pass through a hole 126 on second conductive plate 120. In an exemplary embodiment, center core 116 may further pass through a circular boundary 128 of second cylindrical body 105. In an exemplary embodiment, center core 116 may be further connected to first conductive plate 108.

In an exemplary embodiment, electrically feeding dipole antenna 100 may lead to a radiation by first arm 102. In an exemplary embodiment, the radiation of first arm 102 may induce a surface current on coaxial feed line 112, since coaxial feed line 112 may pass through first arm 102. In an exemplary embodiment, the surface current may radiate with an undesired radiation pattern. In an exemplary embodiment, the undesired radiation pattern of the surface current may deteriorate a desired radiation pattern as well as a gain of dipole antenna 100. In an exemplary embodiment, in order to reduce the impact of the radiation of the surface current, a ferrite sleeve may be utilized.

Figure 1H:
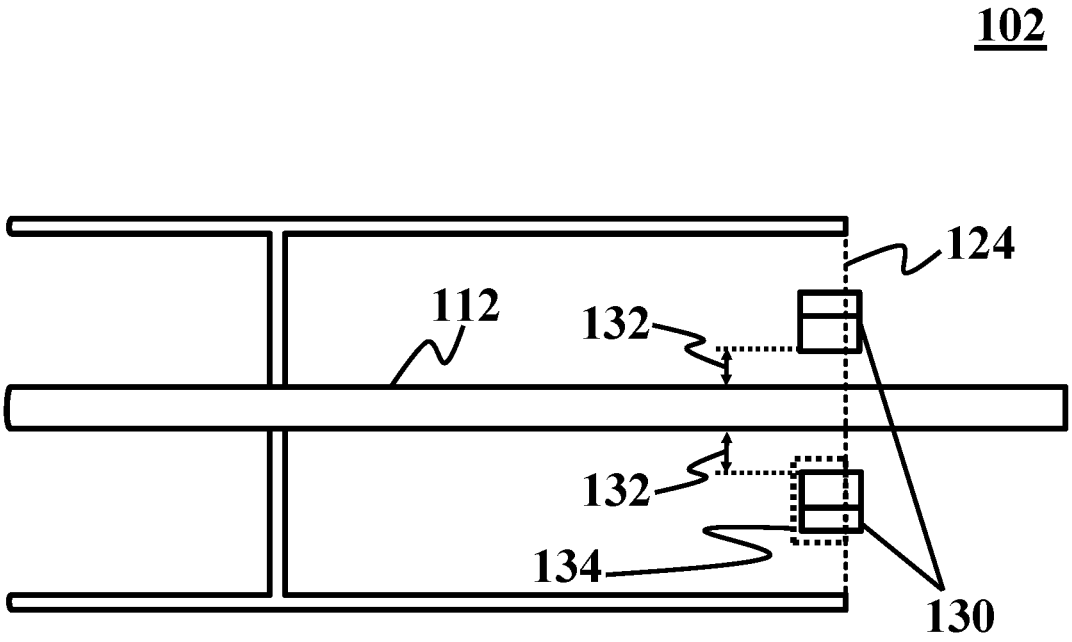
FIG. 1H shows a schematic of a cut view of a first arm of a dipole antenna, consistent with one or more exemplary embodiments of the present disclosure.

FIG. 1H shows a schematic of a cut view of first arm 102 of dipole antenna 100, consistent with one or more exemplary embodiments of the present disclosure. In an exemplary embodiment, dipole antenna 100 may include a ferrite sleeve 130. In an exemplary embodiment, ferrite sleeve 130 may be mounted around coaxial feed line 112. In an exemplary embodiment, utilizing ferrite sleeve 130 may reduce the impact of the radiation of the surface current on coaxial feed line 112 due to a high permeability of ferrite sleeve 130. The permeability of ferrite sleeve 130 may depend on an operating wavelength of dipole antenna 100. In an exemplary embodiment, ferrite sleeve 130 may include a cylindrical ring which may have a distance 132 between an inner surface of the cylindrical ring and coaxial feed line 112. In an exemplary embodiment, the value of distance 132 may affect the ability of ferrite sleeve 130 in reducing the impact of the radiation of surface current on coaxial feed line 112. In an exemplary embodiment, distance 132 may be smaller than about 2 mm. In an exemplary embodiment, ferrite sleeve 130 may have an electrical impedance higher than about 100Ω. In an exemplary embodiment, a location of ferrite sleeve 130 in first arm 102 may affect the ability of ferrite sleeve 130 in reducing the impact of the radiation of surface current on coaxial feed line 112. In an exemplary embodiment, determining the location of ferrite sleeve 130 may be performed by computer simulation. In an exemplary embodiment, the location of ferrite sleeve 130 may vary through inside and outside of first arm 102 and resulting bandwidth associated with each location may be obtained. In an exemplary embodiment, an optimal location of ferrite sleeve 130 may be determined by selecting a location associated with a maximum achieved bandwidth. In an exemplary embodiment, a portion 134 of ferrite sleeve 130 may be disposed inside first arm 102. In other words, in an exemplary embodiment, portion 134 may be located at a left side of second circular boundary 124 in FIG. 1F. In an exemplary embodiment, portion 134 may be at least about 90% of ferrite sleeve 130.

Referring again to FIGS. 1A and 1C, in an exemplary embodiment, a length $l_c$. of cavity 106, a length $l_a$ of dipole antenna 100, and a radius r of first circular boundary 122 may satisfy a set of conditions according to the following:

$$0.02\lambda \le l_c \le 0.05\lambda, \quad \text{Inequation (1a)}$$

$$0.35\lambda \le l_a \le 0.48\lambda, \quad \text{Inequation (1b)}$$

$$0.03\lambda \le r \le 0.07\lambda, \quad \text{Inequation (1c)}$$

where λ is an operating wavelength of dipole antenna 100. In an exemplary embodiment, dipole antenna 100 may have various operating wavelengths. In an exemplary embodiment, a value of λ may be associated with a center operating wavelength of dipole antenna 100 The center operating wavelength of dipole antenna 100 may be associated with a center operating frequency of dipole antenna 100.

Figure 2A:
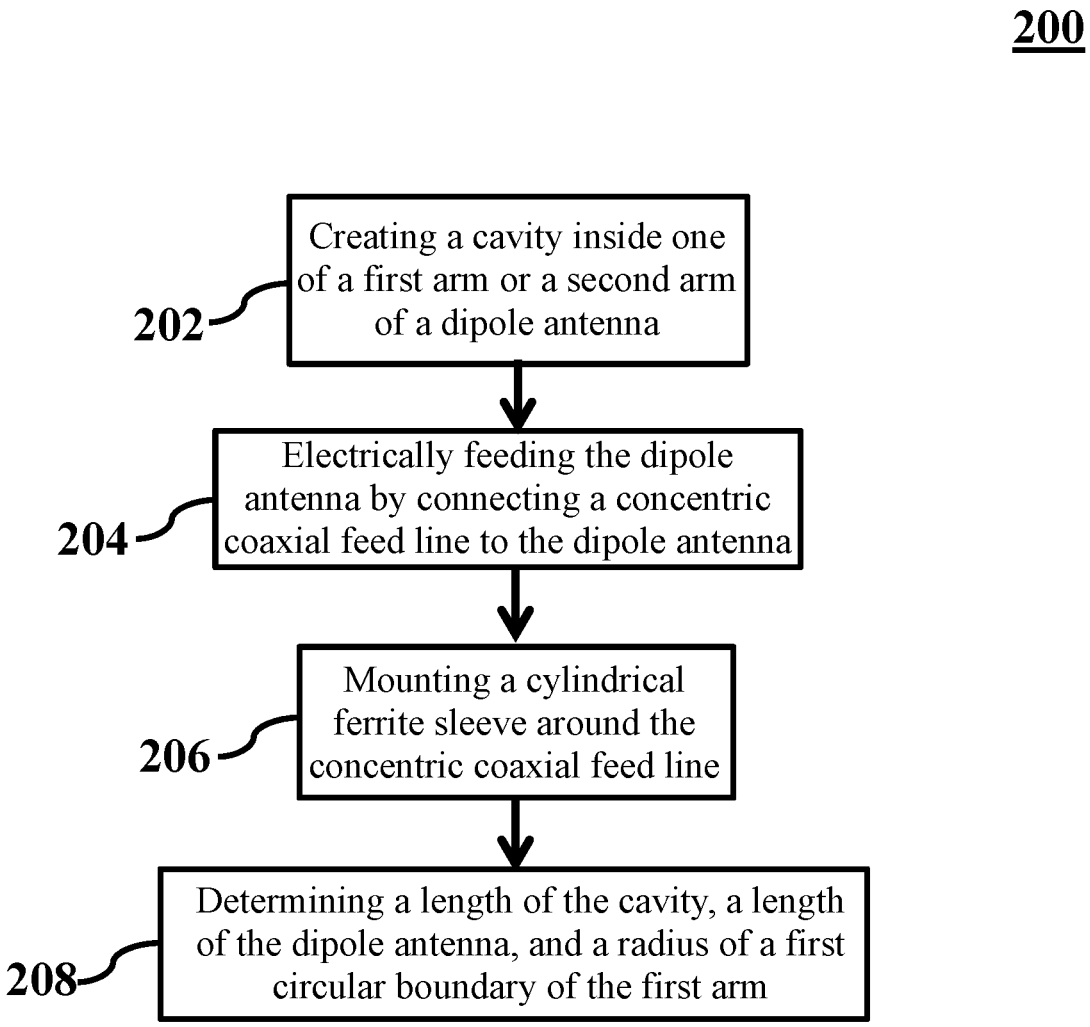
FIG. 2A shows a flowchart of a method for increasing bandwidth of a dipole antenna, consistent with one or more exemplary embodiments of the present disclosure.

Referring again to FIG. 1A, in an exemplary embodiment, dipole antenna 100 may include an air gap 136 between first arm 102 and second arm 104. In an exemplary embodiment, air gap 136 may be filled with a dielectric material including a dielectric constant similar to free space. In an exemplary embodiment, a material of first arm 102 and second arm 104 may include a conductive material. In an exemplary embodiment, a material of at least one of first arm 102 and second arm 104 may include brass. FIG. 2A shows a flowchart of a method for increasing bandwidth of a dipole antenna, consistent with one or more exemplary embodiments of the present disclosure. Referring to FIGS. 1A-2A, in an exemplary embodiment, different steps of a method 200 may be implemented utilizing a dipole antenna analogous to dipole antenna 100. In an exemplary embodiment, the dipole antenna may include a first arm and a second arm. In an exemplary embodiment, the first arm may be analogous to first arm 102. In an exemplary embodiment, the second arm may be analogous to second arm 104. In an exemplary embodiment, method 200 may include creating a cavity inside one of the first arm or the second arm by placing a first conductive plate inside the one of the first arm or the second arm. (step 202). In an exemplary embodiment, the cavity may be analogous to cavity 106. In an exemplary embodiment, the first conductive plate may be analogous to first conductive plate 108. In an exemplary embodiment, when a first conductive plate is placed inside the first arm, a portion of the first arm may be separated from a remaining of the first arm. In an exemplary embodiment, the portion of the first arm may be analogous to portion 1071 of first arm 102. In an exemplary embodiment, the remaining of the first arm may be analogous to remaining 1101 of the first arm 102. In an exemplary embodiment, when a first conductive plate is placed inside the second arm, a portion of the second arm may be separated from a remaining of the second arm. In an exemplary embodiment, the portion of the second arm may be analogous to portion 1072 of second arm 104. In an exemplary embodiment, the remaining of the second arm may be analogous to remaining 1102 of the second arm 104.

In an exemplary embodiment, method 200 may further include electrically feeding the dipole antenna by connecting a coaxial feed line to the dipole antenna through the first arm (step 204). In an exemplary embodiment, the coaxial feed line may be analogous to coaxial feed line 112.

Figure 2B:
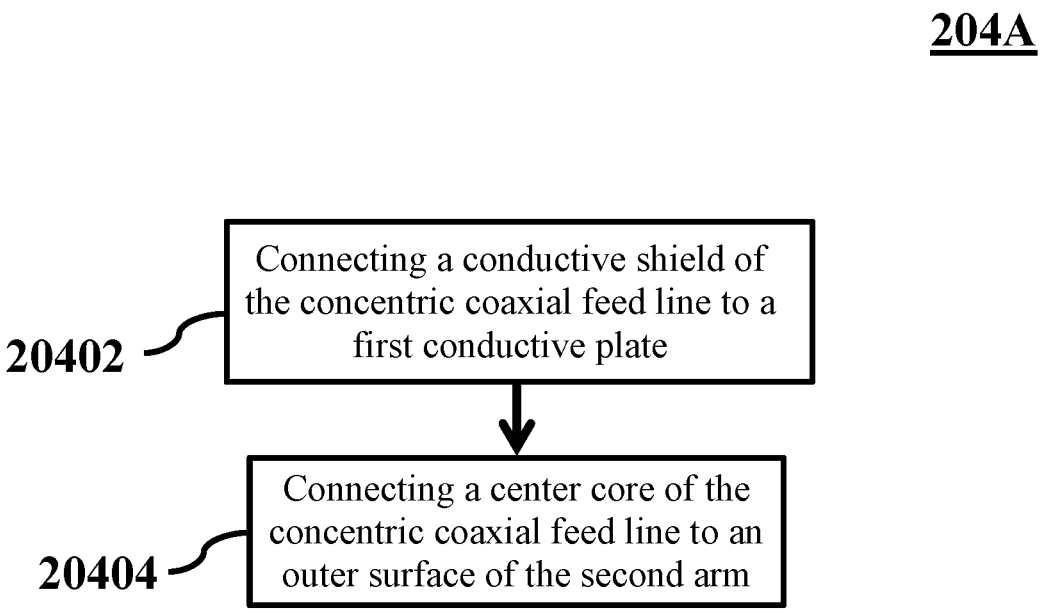
FIG. 2B shows a flowchart for connecting a coaxial feed line to a dipole antenna with a cavity inside a first arm, consistent with one or more exemplary embodiments of the present disclosure.

For further detail with respect to step 204, FIG. 2B shows a flowchart for connecting a coaxial feed line to a dipole antenna with a cavity inside a first arm, consistent with one or more exemplary embodiments of the present disclosure. An exemplary connecting method 204A may be utilized for electrically feeding the dipole antenna when a cavity is created inside the first arm. In an exemplary embodiment, connecting method 204A may include connecting a conductive shield of the coaxial feed line to the first conductive plate by passing the conductive shield through a hole on the first conductive plate (step 20402) and connecting a center core of the coaxial feed line to an outer surface of the second arm (step 20404). In an exemplary embodiment, the conductive shield may be analogous to conductive shield 114. In an exemplary embodiment, the center core may be analogous to center core 116. In an exemplary embodiment, the hole on the first conductive plate may be analogous to hole 119. In an exemplary embodiment, outer surface of the second arm may be analogous to outer surface 118 of second arm 104.

Figure 2C:
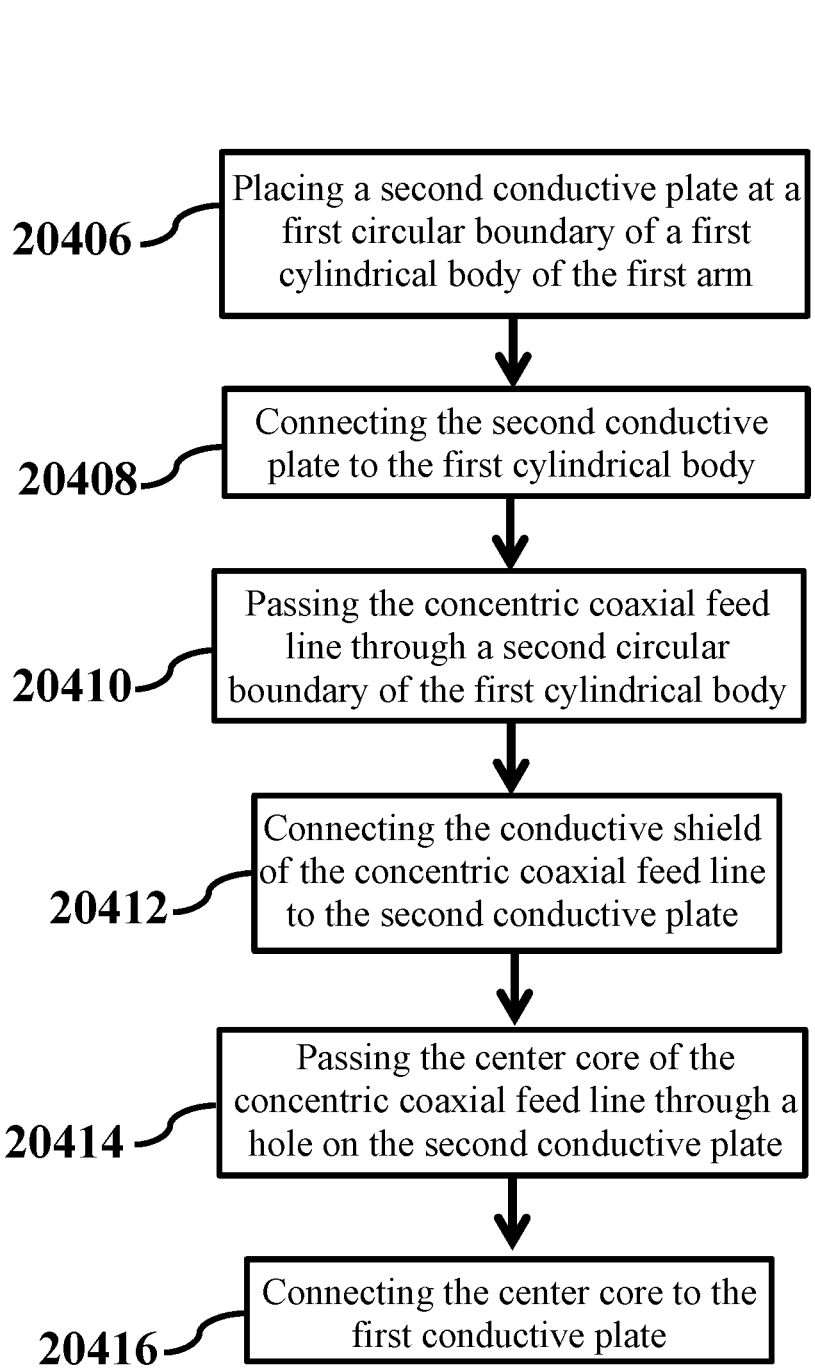
FIG. 2C shows a flowchart for connecting a coaxial feed line to a dipole antenna with a cavity inside a second arm, consistent with one or more exemplary embodiments of the present disclosure.

For further detail with respect to step 204, FIG. 2C shows a flowchart for connecting a coaxial feed line to a dipole antenna with a cavity inside a second arm, consistent with one or more exemplary embodiments of the present disclosure. An exemplary connecting method 204B may be utilized for electrically feeding the dipole antenna when a cavity is created inside the second arm. In an exemplary embodiment, method 204B may include placing a second conductive plate at a first circular boundary of a first cylindrical body of the first arm (step 20406), connecting the second conductive plate to the first cylindrical body (step 20408), passing the coaxial feed line through a second circular boundary of the first cylindrical body (step 20410), connecting a conductive shield of the coaxial feed line to the second conductive plate (step 20412), passing a center core of the coaxial feed line through a hole on the second conductive plate (step 20414), and connecting the center core to the first conductive plate (step 20416). In an exemplary embodiment, the second conductive plate may be analogous to second conductive plate 120. In an exemplary embodiment, the first circular boundary of the first cylindrical body may be analogous to first circular boundary 122. In an exemplary embodiment, the second circular boundary of the first cylindrical body may be analogous to second circular boundary 124 of first cylindrical body 103. In an exemplary embodiment, the hole on the second conductive plate may be analogous to hole 126.

For further detail with respect to step 20406, referring again to FIGS. 1A and 1F, in an exemplary embodiment, the first arm may include a second conductive plate. In an exemplary embodiment, the second conductive plate may be placed at the first circular boundary of the first cylindrical body. In an exemplary embodiment, the first circular boundary of the first cylindrical body may be analogous to first circular boundary 122 of first cylindrical body 103.

For further detail with respect to step 20408, in an exemplary embodiment, the second conductive plate may be in contact with the first cylindrical body. For further detail with respect to step 20410, in an exemplary embodiment, the conductive shield may be connected to the second conductive plate. In an exemplary embodiment, the conductive shield may be analogous to conductive shield 114.

For further detail with respect to step 20412, in an exemplary embodiment, the conductive shield may be connected to the second conductive plate. For further detail with respect to step 20414, in an exemplary embodiment, the center core may pass through the hole on the second conductive plate. In an exemplary embodiment, the center core may be analogous to center core 116.

For further detail with respect to step 20416, referring again to FIGS. 1A and 1F, in an exemplary embodiment, the center core may further pass through a circular boundary of second cylindrical body. In an exemplary embodiment, the center core may be connected to first conductive plate. In an exemplary embodiment, the circular boundary of the second cylindrical body may be analogous to circular boundary 128 of second cylindrical body 105. In an exemplary embodiment, the first conductive plate may be analogous to first conductive plate 108.

Referring again to FIG. 2A, in an exemplary embodiment, method 200 may further include mounting a cylindrical ferrite sleeve around the coaxial feed line (step 206). In an exemplary embodiment, the cylindrical ferrite sleeve may be analogous to ferrite sleeve 130.

In an exemplary embodiment, method 200 may further include determining a length of the cavity, a length of the dipole antenna, and a radius of the first circular boundary (step 208). In an exemplary embodiment, the length of the cavity, the length of the dipole antenna, and the radius of the first circular boundary may satisfy a set of conditions similar to those of Inequations (1a)-(1c). In an exemplary embodiment, determining the length of the cavity, the length of the dipole antenna, and the radius of the first circular boundary may be performed by computer simulation. In an exemplary embodiment, the length of the cavity, the length of the dipole antenna, and the radius of the first circular boundary may vary and resulting bandwidth associated with each length and/or radius may be obtained. In an exemplary embodiment, an optimal length of the cavity, an optimal length of the dipole antenna, and an optimal radius of the first circular boundary may be determined by selecting lengths and/or radius associated with a maximum achieved bandwidth.

EXAMPLE

In this example, a dipole antenna including a first arm and a second arm with a cavity inside the first arm is demonstrated. An exemplary dipole antenna (analogous to dipole antenna 100) includes a first arm (analogous to first arm 102) and the second arm (analogous to second arm 104). The dipole antenna is designed for a desired band of 300 MHz to 400 MHz. The first arm and the second arm of the dipole antenna have a cylindrical body with a radius of about 25 mm. The first arm includes a cavity (analogous to cavity 106) that has a length about 25 mm and a remaining of the first arm (analogous to remaining 1101 of first arm 102 having a length about 140 mm. The total length of the first arm is about 165 mm. The second arm of the dipole antenna has a length of about 195 mm. The first arm and the second arm are spaced by an air gap (analogous to air gap 136) having a length about 7 mm. The total length of the antenna is about 367 mm which is about 0.367 of a maximum operating wavelength of the dipole antenna.

The dipole antenna is electrically fed by connecting a coaxial feed line (analogous to coaxial feed line 112) to the dipole antenna through the first arm. The feeding of the dipole antenna includes connecting a conductive shield (analogous to conductive shield 114) of the coaxial feed line to a first conductive plate (analogous to first conductive plate 108) by passing the conductive shield through a hole on the first conductive plate, and connecting a center core (analogous to center core 116) of the coaxial feed line to an outer surface of the second arm (analogous to outer surface 118 of second arm 104). The impedance of the coaxial feed line is about 50 ohms.

In this example, a cylindrical ferrite sleeve (analogous to ferrite sleeve 130) is mounted around the coaxial feed line having a permeability of about 60 H. Moreover, the ferrite sleeve has an inner radius of about 10 mm, an outer radius of about 28 mm, and a length of about 12 mm.

Figure 3:
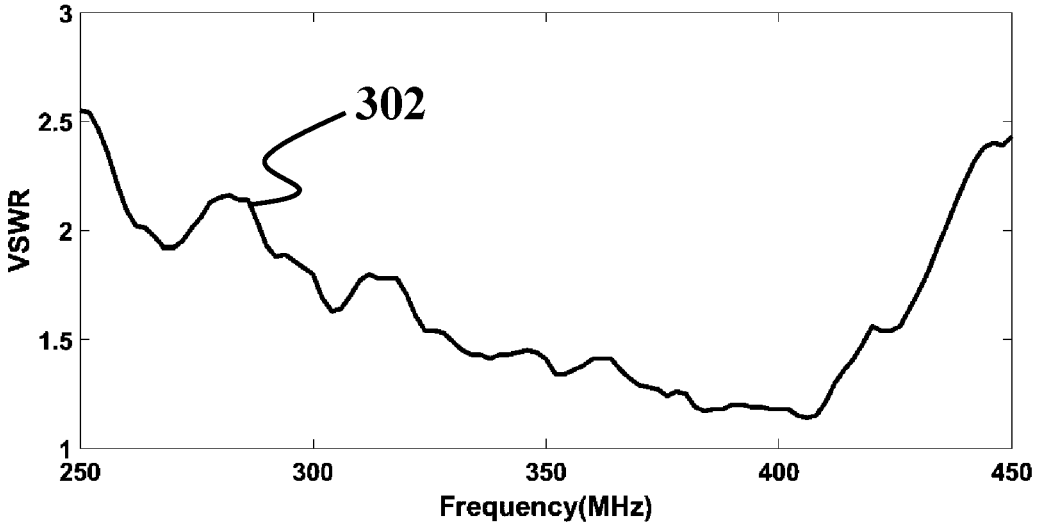
FIG. 3 shows variations of a voltage standing wave ratio of a dipole antenna for different values of operating frequencies, consistent with one or more exemplary embodiments of the present disclosure.

In order to evaluate the performance of the dipole antenna, the variations of a voltage standing wave ratio (VSWR) for different values of operating frequencies are measured. The measurements are performed by an N5230A network analyzer. FIG. 3 shows variations of the VSWR of the dipole antenna for different values of operating frequencies, consistent with one or more exemplary embodiments of the present disclosure. As shown in FIG. 3, the value of a voltage standing wave ratio 302 varies for different operating frequencies in a range of about 250 MHz to about 450 MHz. The bandwidth of the dipole antenna includes a range of operating frequencies with the associated VSWR less than about 2. Therefore, the bandwidth of the dipole antenna includes about 290 MHz to about 440 MHz.

Figure 4:
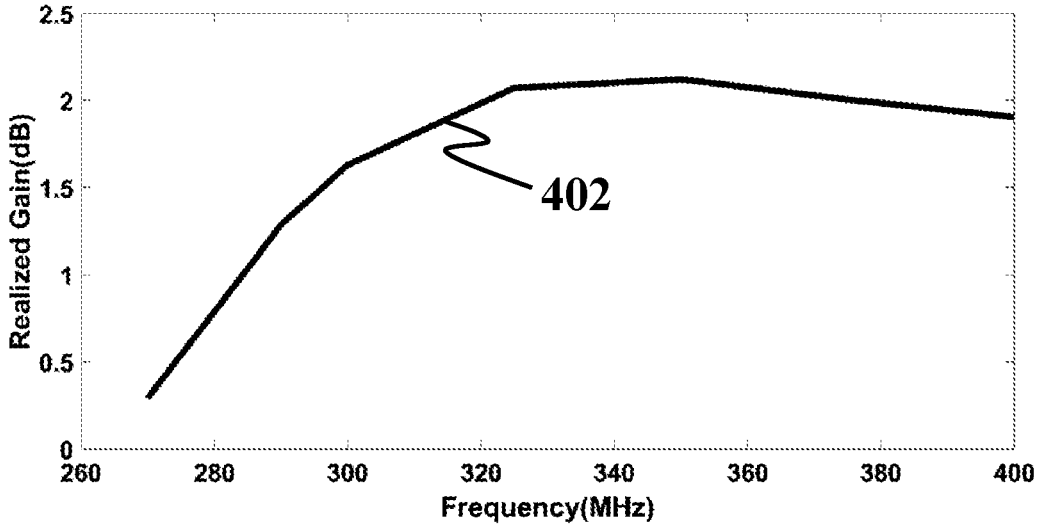
FIG. 4 shows variations of a realized gain of a dipole antenna for different values of operating frequencies, consistent with one or more exemplary embodiments of the present disclosure.

A realized gain and a radiation pattern of the dipole antenna for different values of operating frequencies are measured as well. The measurements are performed in a full anechoic chamber based on a 7-meter standard. FIG. 4 shows variations of the realized gain of the dipole antenna for different values of operating frequencies, consistent with one or more exemplary embodiments of the present disclosure. A realized gain 402 of the dipole antenna is measured within an omnidirectional solid angle around the antenna with an about 30 degrees elevation range. As shown in FIG. 4, the minimum value of realized gain 402 in the desired band (about 300 MHz to about 400 MHz) is above about 1.5 dB.

Figure 5A:
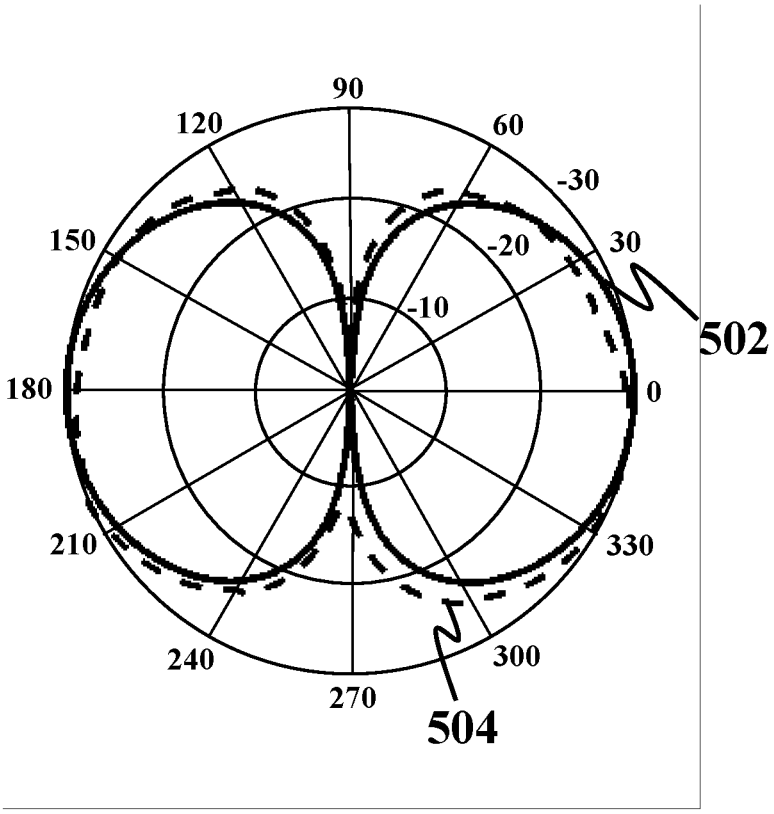
FIG. 5A shows a radiation pattern of a dipole antenna at an operating frequency of 300 MHz, consistent with one or more exemplary embodiments of the present disclosure.
Figure 5B:
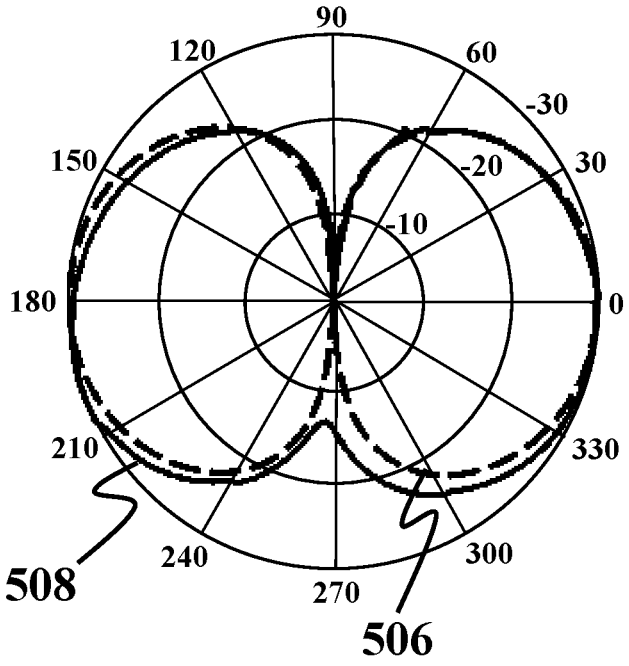
FIG. 5B shows a radiation pattern of a dipole antenna at an operating frequency of 350 MHz, consistent with one or more exemplary embodiments of the present disclosure.
Figure 5C:
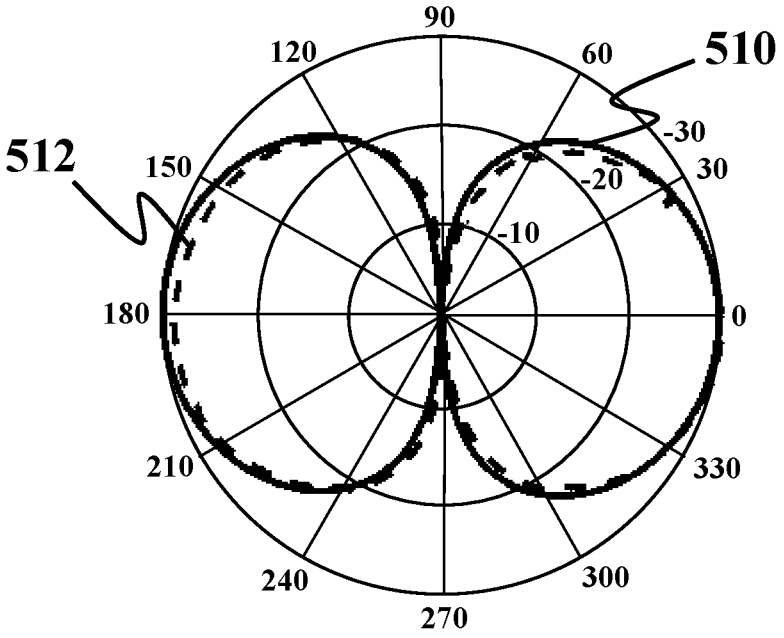
FIG. 5C shows a radiation pattern of a dipole antenna at an operating frequency of 400 MHz, consistent with one or more exemplary embodiments of the present disclosure.

The radiation pattern of the dipole antenna is simulated and measured at three different operating frequencies in the desired band to show that the radiation pattern of the dipole antenna remains omnidirectional throughout the desired band. FIG. 5A shows the radiation pattern of the dipole antenna at an operating frequency of about 300 MHz, consistent with one or more exemplary embodiments of the present disclosure. As FIG. 5A shows, a simulated radiation pattern 502 and a measured radiation pattern 504 are omnidirectional at the operating frequency of about 300 MHz. FIG. 5B shows the radiation pattern of the dipole antenna at an operating frequency of about 350 MHz, consistent with one or more exemplary embodiments of the present disclosure. As FIG. 5B shows, a simulated radiation pattern 506 and a measured radiation pattern 508 are omnidirectional at the operating frequency of about 350 MHz. FIG. 5C shows the radiation pattern of the dipole antenna at an operating frequency of about 400 MHz, consistent with one or more exemplary embodiments of the present disclosure. As FIG. 5C shows, a simulated radiation pattern 510 and a measured radiation pattern 512 are omnidirectional at the operating frequency of about 400 MHz.

While the foregoing has described what may be considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various implementations. This is for purposes of streamlining the disclosure, and is not to be interpreted as reflecting an intention that the claimed implementations require more features than are expressly recited in each claim. Rather, as the following claims reflect, inventive subject matter lies in less than all features of a single disclosed implementation. Thus, the following claims are hereby incorporated into the Detailed Description, with each claim standing on its own as a separately claimed subject matter.

While various implementations have been described, the description is intended to be exemplary, rather than limiting and it will be apparent to those of ordinary skill in the art that many more implementations and implementations are possible that are within the scope of the implementations. Although many possible combinations of features are shown in the accompanying figures and discussed in this detailed description, many other combinations of the disclosed features are possible. Any feature of any implementation may be used in combination with or substituted for any other feature or element in any other implementation unless specifically restricted. Therefore, it will be understood that any of the features shown and/or discussed in the present disclosure may be implemented together in any suitable combination. Accordingly, the implementations are not to be restricted except in light of the attached claims and their equivalents. Also, various modifications and changes may be made within the scope of the attached claims.

What is claimed is:

1. A dipole antenna, comprising:

a first arm comprising a first cylindrical body;

a second arm comprising a second cylindrical body;

a first conductive plate placed inside the first arm, the first conductive plate configured to create a cavity inside the first arm by separating a first portion of the first arm from a remaining portion of the first arm, the first conductive plate comprising a hole;

a coaxial feed line configured to electrically feed the dipole antenna by passing through the first arm, the coaxial feed line comprising:

a conductive shield in contact with the first conductive plate and passing through the hole on the first conductive plate; and a center core connected to an outer surface of the second arm;

a ferrite sleeve comprising cylindrical ring mounted around the coaxial feed line, at least 90% of the ferrite sleeve disposed inside the first arm; and an air gap between the first arm and the second arm, wherein a length $l_c$ of the cavity, a length $l_a$ of the dipole antenna, and a radius r of a first circular boundary of the first cylindrical body satisfy a set of conditions according to the following:

$$0.02\lambda \le l_c \le 0.05\lambda,$$

$$0.35\lambda \le l_a \le 0.48\lambda, \text{ and}$$

$$0.03\lambda \le r \le 0.07\lambda,$$

where λ is an operating wavelength of the dipole antenna.

2. A dipole antenna, comprising:

a first arm comprising a first cylindrical body;

a second arm; and a first conductive plate placed inside one of the first arm or the second arm, the first conductive plate configured to create a cavity inside the one of the first arm or the second arm by separating a first portion of the one of the first arm or the second arm respectively from a corresponding remaining portion of the one of the first arm or the second arm, wherein a length $l_a$ of the dipole antenna, a length $l_c$ of the cavity, and a radius r of the first circular boundary satisfy a set of conditions according to the following:

$$0.35\lambda \le l_a \le 0.48\lambda.$$

$$0.02\lambda \le l_c \le 0.05\lambda, \text{ and}$$

$$0.03\lambda \le r \le 0.07\lambda,$$

where λ is an operating wavelength of the dipole antenna.

3. The dipole antenna of claim 2, further comprising a coaxial feed line configured to electrically feed the dipole antenna by passing through the first arm.

4. The dipole antenna of claim 3, wherein the coaxial feed line comprises:

a conductive shield in contact with the first conductive plate and passing through a hole on the first conductive plate; and a center core connected to an outer surface of the second arm.

5. The dipole antenna of claim 3, wherein:

the first arm further comprises a second conductive plate placed at a first circular boundary of the first cylindrical body, the second conductive plate in contact with the first cylindrical body;

the second arm comprises a second cylindrical body; and the coaxial feed line passes through a second circular boundary of the first cylindrical body.

6. The dipole antenna of claim 5, wherein the coaxial feed line comprises:

a conductive shield connected to the second conductive plate; and a center core passing through a hole on the second conductive plate, passing through a circular boundary of the second cylindrical body, and connected to the first conductive plate.

7. The dipole antenna of claim 5, further comprising a ferrite sleeve mounted around the coaxial feed line.

8. The dipole antenna of claim 7, wherein the ferrite sleeve comprises a cylindrical ring, a distance between an inner surface of the cylindrical ring and the coaxial feed line being smaller than 2 mm.

9. The dipole antenna of claim 7, wherein the ferrite sleeve comprises an electrical impedance higher than 100 Ω.

10. The dipole antenna of claim 7, wherein at least 90% of the ferrite sleeve is disposed inside the first arm.

11. The dipole antenna of claim 2, further comprising an air gap between the first arm and the second arm.

12. The dipole antenna of claim 2, wherein a material of at least one of the first arm and the second arm comprises brass.

13. A method for increasing bandwidth of a dipole antenna comprising a first arm and a second arm, the method comprising:

creating a cavity inside one of the first arm or the second arm by separating a first portion of the one of the first arm or the second arm respectively from a corresponding remaining portion of the one of the first arm or the second arm through placing a first conductive plate inside the one of the first arm or the second arm; and determining a length $l_c$ of the cavity, a length $l_a$ of the dipole antenna, and a radius r of a first circular boundary of a first cylindrical body of the first arm according a set of conditions defined by the following:

$$0.02\lambda \le l_c \le 0.05\lambda,$$

$$0.35\lambda \le l_a \le 0.48\lambda, \text{ and}$$

$$0.03\lambda \le r \le 0.07\lambda,$$

where $\lambda$ is an operating wavelength of the dipole antenna.

14. The method of claim 13, further comprising electrically feeding the dipole antenna by connecting a coaxial feed line to the dipole antenna through the first arm.

15. The method of claim 14, wherein connecting the coaxial feed line to the dipole antenna comprises:

connecting a conductive shield of the coaxial feed line to the first conductive plate by passing the conductive shield through a hole on the first conductive plate; and connecting a center core of the coaxial feed line to an outer surface of the second arm.

16. The method of claim 14, wherein connecting the coaxial feed line to the dipole antenna comprises:

placing a second conductive plate at the first circular boundary;

connecting the second conductive plate to the first cylindrical body;

passing the coaxial feed line through a second circular boundary of the first cylindrical body;

connecting a conductive shield of the coaxial feed line to the second conductive plate;

passing a center core of the coaxial feed line through a hole on the second conductive plate; and connecting the center core to the first conductive plate.

17. The method of claim 16, further comprising mounting a cylindrical ferrite sleeve comprising an electrical impedance higher than 100 Ω around the coaxial feed line on a distance smaller than 2 mm from the coaxial feed line by placing at least 90% of the cylindrical ferrite sleeve inside the first arm.

* * * * *